US010234085B2

(12) United States Patent
Ladstaetter et al.

(10) Patent No.: US 10,234,085 B2
(45) Date of Patent: Mar. 19, 2019

(54) LIGHTING STRIP SYSTEM

(71) Applicant: ZUMTOBEL LIGHTING GMBH, Dornbirn (AT)

(72) Inventors: Gerald Ladstaetter, Klaus (AT); Gerhard Galler, Bregenz (AT); Thomas Rein, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 239 days.

(21) Appl. No.: 14/762,406

(22) PCT Filed: Jan. 24, 2014

(86) PCT No.: PCT/EP2014/051417

§ 371 (c)(1),
(2) Date: Jul. 21, 2015

(87) PCT Pub. No.: WO2014/114757

PCT Pub. Date: Jul. 31, 2014

(65) Prior Publication Data

US 2015/0354795 A1 Dec. 10, 2015

(30) Foreign Application Priority Data

Jan. 25, 2013 (DE) ..... 10 2013 201 203

(51) Int. Cl.
*F21S 2/00* (2016.01)
*F21S 8/06* (2006.01)
(Continued)

(52) U.S. Cl.
CPC . *F21S 2/00* (2013.01); *F21S 8/06* (2013.01); *F21V 21/03* (2013.01); *F21V 23/001* (2013.01);
(Continued)

(58) Field of Classification Search
CPC .... F21V 23/001; F21V 23/002; F21V 23/003; F21V 21/005
See application file for complete search history.

(56) References Cited

U.S. PATENT DOCUMENTS 5,664,957 A 9/1997 Starr
2003/0081419 A1* 5/2003 Jacob ..... F21S 8/04 362/364

(Continued)

FOREIGN PATENT DOCUMENTS

DE 4113210 10/1992
DE 202005019282 4/2007

(Continued)

OTHER PUBLICATIONS

International Search Report for PCT/EP2014/051417, English translation attached to original, Both completed by the European Patent Office dated Mar. 5, 2014, All together 5 Pages.

(Continued)

*Primary Examiner* — Anh T Mai
*Assistant Examiner* — Zachary J Snyder
(74) *Attorney, Agent, or Firm* — Brooks Kushman P.C.

(57) ABSTRACT

In a lighting strip system having an elongate support arrangement for holding lamp units and lines for electricity supply and/or signal transmission, the support arrangement has an I-shaped profile in cross section, with two receiving regions, which run in the longitudinal direction of the support arrangement and are separated by a preferably vertically aligned partition, wherein the lines for electricity supply and/or signal transmission are arranged in one of the receiving regions and operational devices of the lamp units are arranged in the other receiving region.

12 Claims, 2 Drawing Sheets

(51) Int. Cl.

| | |
|---|---|
| ***F21V 15/01*** | (2006.01) |
| ***F21V 21/03*** | (2006.01) |
| ***F21V 23/00*** | (2015.01) |
| ***F21V 21/002*** | (2006.01) |

(52) U.S. Cl.
CPC ..... *F21V 23/002* (2013.01); *F21V 15/01* (2013.01); *F21V 21/002* (2013.01)

(56) References Cited

U.S. PATENT DOCUMENTS

2009/0225546 A1* 9/2009 Pearson ..... F21S 2/005 362/249.06
2010/0002426 A1* 1/2010 Wu ..... F21V 7/0016 362/223
2011/0285314 A1* 11/2011 Carney ..... E04B 9/006 315/294
2012/0063138 A1* 3/2012 Leadford ..... F21S 2/005 362/249.02
2013/0021792 A1* 1/2013 Snell ..... F21V 7/0008 362/218
2013/0094225 A1* 4/2013 Leichner ..... F21S 2/005 362/368
2014/0049954 A1 2/2014 Ladstaetter
2015/0029731 A1* 1/2015 Jelinek ..... F21V 31/005 362/362

FOREIGN PATENT DOCUMENTS

| | | |
|---|---|---|
| DE | 202007017735 | 2/2008 |
| DE | 102010043140 | 5/2012 |
| DE | 102011017702 | 10/2012 |
| EP | 1241760 | 9/2002 |

OTHER PUBLICATIONS

German Search Report for German Application No. DE 10 2013 201 203.9, Completed by the German Patent Office, dated Sep. 9, 2013, 8 Pages.

* cited by examiner

LIGHTING STRIP SYSTEM

CROSS-REFERENCE TO RELATED APPLICATION

This application is the U.S. national phase of PCT Application No. PCT/EP2014/051417 filed on Jan. 24, 2014, which claims priority to DE Patent Application No. 10 2013 201 203.9 filed on Jan. 25, 2015, the disclosures of which are incorporated in their entirety by reference herein.

The present invention relates to a lighting strip system according to the pre-characterizing clause of claim 1, which has an elongate support arrangement for holding lamp units and lines for electricity supply and/or signal transmission.

Lighting strip systems of this type are distinguished by their high flexibility with regard to the arrangement and configuration of the lighting system that is ultimately obtained. As compared with systems with fixedly installed lights, lighting strip systems offer the possibility of positioning lamp units relatively flexibly at desired points and in a desired way and, furthermore, of still making changes at a later time even after installation of the system. Usually, the replacement of a lamp unit in a lighting strip system can be carried out relatively simply, so that the lighting can at any time be matched to the current desires. On account of the fact that different lamp units with different light sources and optical units are available, in this way lighting scenarios of an extremely wide range of types can be implemented.

The prior art discloses various lighting strip systems which differ in particular with regard to the mounting of the lines for electricity supply and signal transmission and the question of flexibility during the positioning of the lamp units. Usually, insulated cable looms, which are connected to contact-making modules at specific predefined positions, run within the elongate support arrangement. The corresponding lamp units can then be connected to these contact-making modules, so that the possibilities for positioning the lamp units are also predefined by the arrangement of the contact-making modules. The contact-making modules are usually then arranged at regular intervals, so that a continuous arrangement of lamp units arranged one after another in the longitudinal direction of the lighting strip system is made possible.

Another possibility is to arrange the lines for electricity supply and/or signal transmission within the support arrangement in such a way that completely free positioning of the lamp units is made possible. One such solution is provided, for example, in the "TECTON" lighting strip system from the applicant. The cables, which are now not insulated, run in specific profile elements, which are arranged within the support arrangement and are configured in such a way that the cables are freely accessible, that is to say contact can be made therewith, at any point. In this way, the greatest possible flexibility is created, since the positioning of the lamp modules is not restricted to a few predefined positions. On the other hand, since for safety reasons it is necessary to ensure that the electricity supply cables—normally having a voltage in the region of 220 V—are not inadvertently touched, the profile elements in the known lighting strip system have to be configured in a very complicated way, which entails a high outlay.

The present invention is based on the object of providing a novel type of solution for the implementation of a lighting strip system which can be installed simply and opens up to the end user the possibility of carrying out repair or maintenance work in a straightforward way even after installation of the system and, if appropriate, of being able to lay additional lines within the support arrangement.

The object is achieved by a lighting strip system having the features of claim 1. Advantageous developments of the invention are the subject matter of the dependent claims.

The lighting strip system according to the invention exhibits numerous innovations as compared with solutions known hitherto. Overall, the system according to the invention has a modular character, which permits very simple mounting. At the same time, an extremely wide range of lamp units and optical units for use on the lighting strip system are available to the end user, and maintenance or repair work can be carried out simply.

A first special property of the lighting strip system according to the invention consists in the configuration of the support arrangement. While, until now, the support rails used in lighting strip systems usually have a U shape that is open at the bottom, provision is made in the system according to the invention for the support arrangement to have an I-shaped profile in cross section, by which means two receiving regions running in the longitudinal direction and separated by a partition are formed. One of the receiving regions here is used for the arrangement of the lines for electricity supply and/or signal transmission, while, on the other hand, the operating devices of the lamp units are arranged in the other receiving region.

According to a first aspect of the present invention, a lighting strip system having an elongate support arrangement for holding lamp units and lines for electricity supply and/or signal transmission is accordingly proposed, wherein, according to the invention, the support arrangement has an I-shaped profile in cross section with two receiving regions which run in the longitudinal direction of the support element and are separated by a—preferably vertically aligned—partition, wherein the lines for electricity supply and/or signal transmission are arranged in one of the receiving regions and operating devices of the lamp units are arranged in the other receiving region.

According to the invention, therefore, in the present case the lines, in particular the electricity-carrying lines, are arranged so as to be separated from the operating devices of the lamp units. Apart from higher security, which rules out inadvertent touching of the lines during work on the lamp unit or on the operating device, possible problems with regard to the electromagnetic compatibility, as it is known, are also ruled out on account of the separation of the feed-through wiring and the internal wiring. These problems occurred again and again in lighting strip systems in which the feed-through wiring and the operating devices were arranged within the same space or region, for which reason specific measures had to be taken here in order to avoid these problems. With the configuration of the support arrangement according to the invention, such problems are avoided from the start in a very simple and elegant way. Furthermore, the I-shaped configuration of the support arrangement is also distinguished by high stability in the longitudinal direction, which leads to further advantages.

The support arrangement itself is preferably formed by a plurality of I-shaped profile elements arranged one after another in the longitudinal direction. Electric connecting elements for the lines for electricity supply and/or signal transmission are then respectively provided at the ends of the profile elements. This means that the individual profile elements can be supplied with the wiring already installed, the end user then merely having to join the profile elements together and produce the electric connection. The outlay on mounting is reduced to an extreme extent in this way, continuous wiring nevertheless being created with the effect of a lighting strip system.

Preferably, the I shape of the profile elements is obtained by each profile element being formed by two C-shaped profile parts, which are each arranged back-to-back. The outlay for producing C-shaped profile parts is considerably lower, for which reason in this way the advantageous I-shaped configuration of the support arrangement can be obtained in a very simple but efficient manner. Within the partition there are then preferably provided openings, in which a contact-making socket for making contact with the lines of the feed-through wiring through the operating devices is respectively arranged.

As a result, the lighting strip system according to the invention is arranged or fixed on a ceiling in such a way that the partition—as already mentioned—is aligned vertically. The two receiving regions of the support arrangement therefore run beside each other and are separated by the partition, which in turn means that they are initially open toward the outside. According to an advantageous development of the invention, provision is therefore made for the receiving regions to be each closed off by side walls opposite the partition, wherein these side walls can be fixed detachably to the support arrangement. This means that access to the operating device of a lamp unit which is arranged in a receiving region can be obtained in a straightforward way by the side wall being taken off the support arrangement. In the same way, the opposite receiving region for the lines can also be opened by removing the side wall, which ultimately opens up the possibility of arranging additional cables in this receiving region without great effort, which cables can then be used for other purposes. For instance, in a very simple manner, lines, e.g. for loudspeakers, video monitoring or the like, could be integrated into the system in this way. In addition, repair or maintenance work, for example the replacement of an operating device, can be carried out in a very simple manner without complete disassembly of the corresponding lamp unit being required.

In this connection, it should be mentioned that the use of such removable side walls could also be employed in the case of U-shaped profile elements as support rails of lighting strip systems. Accordingly, this aspect is also the subject matter of a further independent claim, according to which a lighting strip system having an elongate support arrangement for holding lamp units and lines for electricity supply and/or signal transmission is proposed, wherein the support arrangement has at least one receiving region running in the longitudinal direction of the support arrangement for the support of the lines for electricity supply and/or signal transmission and/or the support of operating devices of the lamp units, and wherein the receiving region is closed on at least one side by detachably fixable side walls.

A particularly advantageous embodiment of the use of the removable side walls consists further in the fact that—viewed in the light emission direction—said side walls have protruding extensions, by which optical means for influencing the output of light from the lamp units are formed. In particular, these protruding extensions can form reflectors, which can then be configured differently with regard to their shape, so that the end user is able to use different optical units on the lighting strip system. Alternatively or additionally thereto, an arrangement of optical elements separate from the removable side walls would of course also be conceivable.

Overall, the present invention accordingly creates a novel type of lighting strip system which is simple to mount but at the same time still offers the end user flexible possibilities for the arrangement of lamp units. Furthermore, repair or maintenance work is made easier and the laying of additional lines for other purposes is made possible.

The invention is to be explained in more detail below by using the appended drawing, in which.

Figure 1:
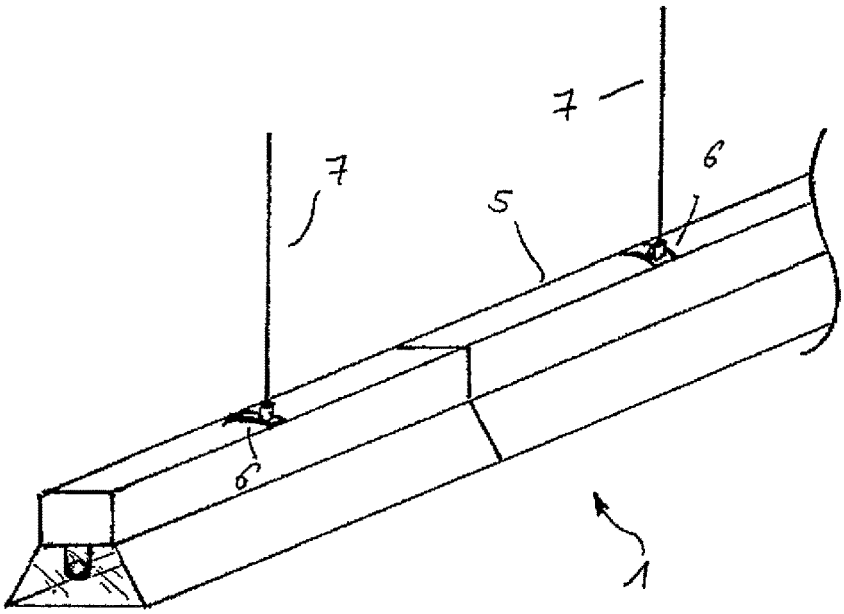
FIG. 1 shows a perspective view of a section of a lighting strip system according to the invention.

Firstly, FIG. 1 shows generally a sub-region of a lighting strip system 1, wherein the system 1 can be configured in any desired length in a known way. The central component is an elongate support arrangement 5, which is used as a support for the entire system 1 and can be fixed in different ways to an external support, for example the ceiling of a room or the like. Illustrated in the present case is a cable suspension, in which, at specific distances on the upper side of the support arrangement 5, there are arranged retaining clamps 6, which are connected to the external support via corresponding cables 7. Direct mounting of the support arrangement 5 on the ceiling of a room would also be conceivable.

The support arrangement 5, as is usual in lighting strip systems 1, is used to hold the lamp units and to support the lines for electricity supply and/or signal transmission, what is known as the feed-through wiring. This feed-through wiring extends over the entire length of the support arrangement 5 and, in the present case, permits the arrangement at specific positions of operating devices of the lamp units, which then make contact with the wires of the feed-through wiring. The feed-through wiring therefore firstly ensures the electricity supply of the lamp units and, secondly, is also possibly used for the signal transmission, in order to be able to activate the lamps from a central control device. Furthermore, optical elements for influencing the output of light are also arranged directly or indirectly on the support device 5.

In the present case, the lighting strip system 1 according to the invention is built up modularly, wherein the individual modules are respectively represented by a combination comprising support device 5, lamp unit and optical unit. These modules then merely have to be connected to one another at the ends in order to form the lighting strip system 1 overall, wherein, by producing an electrical connection, it is also ensured that the feed-through wiring extends over the entire length, as distinct from a serial arrangement of individual lamps. As a result of the modular design, particularly simple mounting of the lighting strip system 1 is made possible; at the same time, however, the system is configured in such a way that the end user can nevertheless carry out repair or maintenance work in a straightforward manner. For instance, a subsequent phase selection for the lamp units or a replacement of the ballast in the event of failure can be carried out at any time. This is ensured by the specific configuration, in particular of the support arrangement 5, which is to be explained in more detail below.

In accordance with the perspective view of FIG. 1, the support arrangement 5, seen in outline, is configured to be approximately square or rectangular, as is also the case in classic U-shaped support rails. As opposed to the lighting strip systems known hitherto, having U-shaped support rails, however, in the present case the support arrangement 5 is formed by I-shaped profile elements 10, which are arranged one after another in the longitudinal direction and form the individual modules of the lighting strip system 1.

Figure 2:
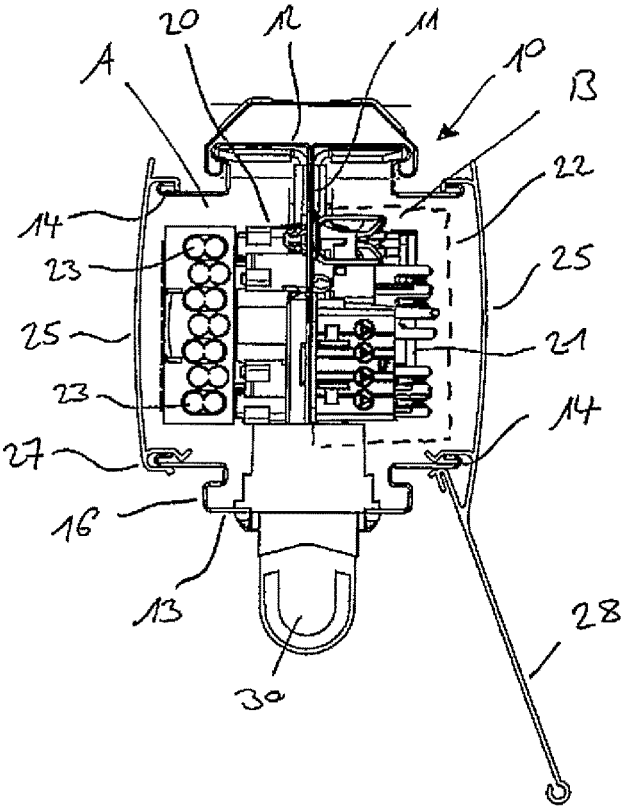
FIG. 2 shows a sectional illustration of the lighting strip system according to the invention.
Figure 3:
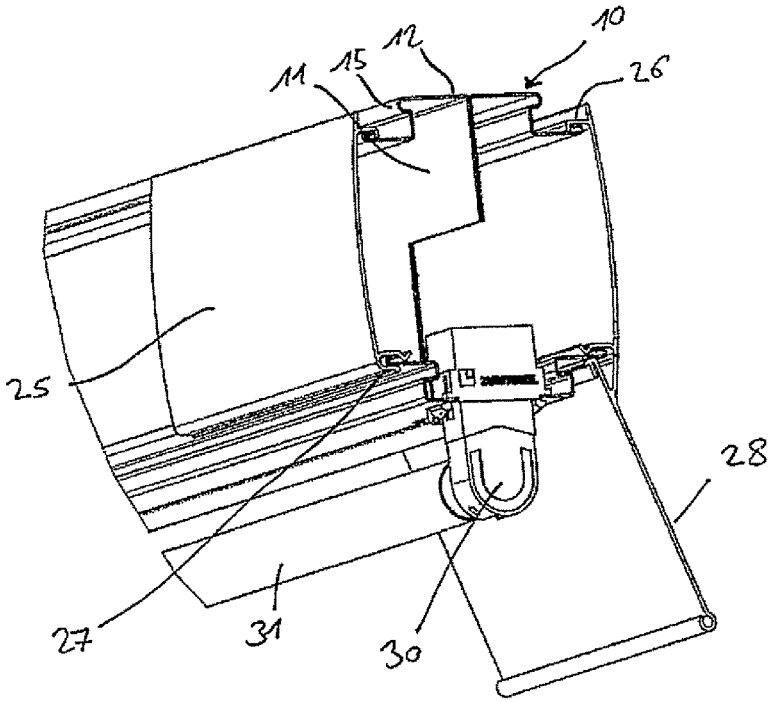
FIG. 3 shows a perspective view of an end region of an individual module of the lighting strip system, and FIG. 4 once more shows the view of an end region of a module of the lighting strip system according to the invention, wherein LEDs are used as light sources here.

The I shape of the profile elements 10 can be gathered from the illustrations of FIGS. 2 and 3. This I shape results in a vertical central web 11 being formed, at the upper end and lower end of which terminating walls 12 and 13 running horizontally are respectively formed. The two terminating walls 12 and 13 are not flat but are designed to be profiled, corresponding to the illustration, wherein they are bent over in particular at their lateral end regions and in this way form latching elements 14 which—as described in more detail below—are used in particular for fixing removable side walls. The profiled form of the upper terminating wall 12 are further used to fix the clamps 6 already mentioned for fixing a cable suspension to the profile elements 10. Here, too, the clamps 6, which are preferably clicked or snapped onto the profile elements 10 from the upper side, engage behind corresponding protrusions 15.

On the underside of the I-shaped profile element 10, the mountings 30 of the lamp units of the lighting strip system 1 are arranged. These mountings 30 are used to hold the light sources 31, which, in the illustrated case, are fluorescent lamps. In a variant, described in more detail later, LED light sources can also be used alternatively hereto. The lamp mountings 30 are connected to the operating device which is responsible for the electricity supply and the operation of the lamps 31 and is correspondingly arranged in the receiving region of the support device 5. Furthermore, optical elements could also be fixed to the underside 13 of the body 11 in order to influence the output of light. For example, the protrusions 16 for snapping on corresponding elements can be used for this purpose.

As opposed to known lighting strip systems, in the present case the light sources and the mountings for the light sources are therefore arranged directly to the profile element 10 of the support arrangement 5, so that profile element and lamp unit represent one unit. This "all-in-one configuration" constitutes a further special feature of the system according to the invention, by means of which the final mounting is further simplified for the consumer.

The I-shaped configuration of the profile elements 10 further results in free spaces or receiving regions A and B running in the longitudinal direction of the lighting strip system 1 being formed on both sides of the partition 11. These regions A, B are separated from each other by the partition 11 and are used to receive different components of the lighting strip system 1. In particular, provision is made for one of the two regions, the left-hand receiving region A in the present case, to be used for the arrangement and support of the feed-through wiring 23, whereas, on the other hand, the operating devices 22 of the lamp units are arranged in the other or right-hand region B. For this purpose, provision is made in particular for the feed-through wiring 23 to be formed by insulated cable looms, which run in the longitudinal direction of the lighting strip system 1. At the respective ends of an individual module of the lighting strip system 1, electric connecting elements are then provided for the connection to the adjacent module and, when the lighting strip system is joined together, simply have to be coupled to one another in order to implement the feed-through wiring.

At the same time, when connecting two adjacent modules, a mechanical connection must also be ensured, which is carried out in particular by means of C-shaped connecting parts—not illustrated—which are pushed into the I-shaped profile elements. These connecting parts bridge the connecting region between two adjacent modules and ensure adequate fixing. Provision can be made for the connecting parts each to be connected fixedly to one of the modules, which can be done by clinching, for example. After the adjacent module has been pushed on, this is then fixed to the connecting part with the aid of specific latching springs or the like, so that the modules cannot inadvertently be detached from one another.

At specific positions of an individual profile element, making contact with the feed-through wiring 23 is made possible, as already mentioned. For this purpose, specific contact-making sockets 20 are provided which, at these positions, penetrate the insulation of the feed-through cabling and make contact with the corresponding lines. The contact-making sockets 20 then reach through corresponding openings in the partition 11 and it is thus possible to access and make contact with the former from the opposite receiving region B. At the corresponding positions, it is then possible to fit connecting elements 21 to be coupled to the contact-making sockets 20, via which a connection to the corresponding—schematically indicated—operating device 22 of the lamp unit is then made. Preferably, the contact-making sockets 20 are snapped into the openings, by which means retention of the feed-through wiring 23 in the receiving region B is also simultaneously carried out.

This means that only at the positions provided for making contact is an opening provided in the partition 11, corresponding connection of an operating device 22 of the lamp unit then being possible here. The right-hand receiving region B can accordingly be used without further interfering elements for the arrangement of the operating devices 22. At the same time, the separation of the receiving regions A and B, that is to say the regions for the feed-through cabling 23 and the operating devices, ensures that there are no problems with regard to electromagnetic compatibility. While, in lighting strip systems known hitherto, the cables for the feed-through wiring and the operating devices were arranged in the same space and this could lead to corresponding problems, such difficulties are ruled out from the start in the present system.

The I-shaped configuration of the profile elements 10 further has the result that the receiving regions A and B are initially open at the side. Since, of course, the system overall is intended to have a closed impression, provision is made for the receiving regions A and B to be closed by side walls 25, which are configured so as to be removable, that is to say can be snapped onto the profile elements 10 in a straightforward manner and removed again. In particular, on the upper and lower side, the side walls 26 have appropriate respective protrusions 26 and 27, which interact with the end regions 14 of the upper and lower terminating wall 12, in such a way that the side walls 25 are simply firstly hooked in on the upper side and can then be snapped onto the profile element 10 at their lower side. Detachment of the side walls 25 also again takes place in the reverse manner, so that the receiving regions A and B can be opened and closed again very simply.

The simple possibility of obtaining access to the receiving regions A and B is also associated in particular with the advantage that repair and maintenance work can be carried out very simply or that there is the possibility of laying additional lines. Obviously, as a result of taking off the right-hand side wall, access can be obtained to the operating devices, so that the latter can be replaced very simply in the event of a fault. Furthermore, additional cables or lines can be laid in the receiving region A if required without problems and can then be used for other purposes. Conceivable, for example, would be the laying of cables for loudspeakers or for video monitoring.

This concept of the removable side walls leads to particular advantages and could accordingly also be used in profile elements configured in other ways, in particular also in the case of U-shaped profile elements. Here, too, the advantage is obtained that access to the receiving region, for example for the operating devices, is obtained in a simple way, so that the latter can be changed without the whole lamp unit having to be taken off or removed. In the present case of the I-shaped profile elements, there is furthermore also no danger that the removable side walls will impair the stability of the system, since the I shape, taken on its own, is already sufficiently rigid so that a stable system is obtained even over relatively great lengths.

A further special feature in the concept of the removable side walls consists further in the fact that these can have extensions 28 that protrude in the light emission direction. By means of these extensions 28, which in the present case are formed in the manner of wings, optical elements for influencing the output of light can then be formed. This can be implemented in a simple way by the wings being designed to be reflective, at least on their inner side, and in this way forming reflector wings extending in the longitudinal direction. Obviously, these extensions 28 can be shaped and configured as desired in order to influence the output of light in different ways. Depending on the way in which the side wall 25 with the extension 28 arranged thereon is configured, it is therefore then possible for the lamp units to have different optical units. However, optical units can of course also be fixed directly to the profile element, which would be recommended, for example, if they are optical units made of a translucent material which are intended to enclose the light sources 31 completely or to influence the output of light by refraction and/or scattering.

With regard to the I-shaped profile elements, it should be noted further that these are preferably not formed in one piece for technical production reasons, since this would be associated with high outlay and correspondingly high costs. Preferably, provision is instead made for a profile element to be formed from two C-shaped profile parts, which are each arranged back-to-back in order ultimately to result in the I shape illustrated. In this case, the partition 11 is therefore implemented with double walls, which leads to additionally increased stability. The two profile parts 10*a* and 10*b* are then preferably non-detachably connected to each other, which can in turn be carried out, for example, by means of clinching.

Figure 4:
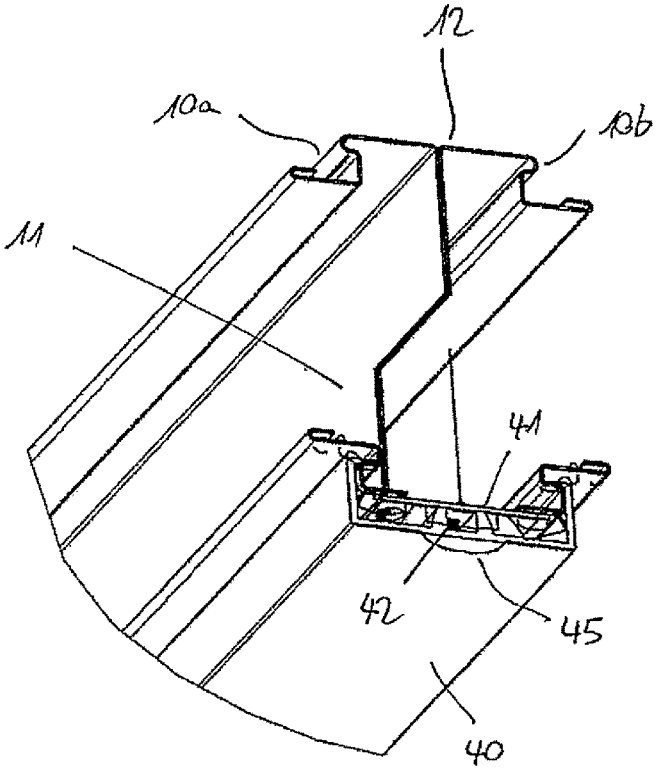

FIG. 4 finally shows a variant of the lighting strip system according to the invention, in which, instead of the fluorescent lamps illustrated previously, LEDs are now used as light sources. To this end, an appropriate unit 40 is snapped onto the I-shaped profile element 10 from the lower side. The unit in this case has a circuit board 41 with LEDs 42 arranged thereon. At the same time, it forms a primary optical unit in that the central region 45 is formed in the manner of a lens. The unit 40 is preferably attached to the profile element 10 as a whole, that is to say with the LED circuit board already arranged thereon. As an alternative to this, it would also be possible initially for only the LED circuit board to be fixed to the lower side of the profile element 10 and then for the primary optical unit 45 consisting of a transparent material to be attached as illustrated.

With regard to its further configuration, the variant of FIG. 4 is identical to the variant previously described. Here, too, the feed-through cabling and the operating devices of the lamp units are therefore arranged separately in the two receiving regions A and B, wherein openings are provided in the partition 11 at specific positions in order to permit contact to be made with the cabling. Once more, removable side walls can be attached and, if appropriate, can form additional optical units. In FIG. 4, the two-part configuration of the I-shaped profile element, that is to say the arrangement of two C-shaped profile parts back-to-back, can also be seen well once more.

Overall, therefore, by means of the present invention, a lighting strip system is created which is very simple to mount but nevertheless opens up various possibilities for the users with regard to the configuration of the lamp units. Furthermore, maintenance work on the system is made considerably easier on account of the removable side walls.

The invention claimed is:

1. A lighting strip system comprising:

an elongate support arrangement for holding lamp units and lines for electricity supply and/or signal transmission, wherein the support arrangement is formed from two C-shaped profile parts, which are joined together back-to-back to create a vertically aligned I-shaped profile in cross section with two horizontally outwardly facing C-shaped receiving regions which run in the longitudinal direction of the support arrangement and are separated by a vertically aligned partition spanning between horizontally extending upper and lower side walls of the two C-shaped profile parts, and a lamp mounting fixture, for receiving lamp units, mounted on an underside surface of the lower end walls of the two C-shaped profile parts, wherein the lines for electricity supply and/or signal transmission are arranged in one of the receiving regions and operating devices of the lamp units are arranged in the other receiving region, wherein the support arrangement is further provided with protrusions extending from outboard edges of the upper and lower end walls of the two C-shaped profile parts.

2. The lighting strip system as claimed in claim 1, wherein the support arrangement is formed by a plurality of I-shaped profile elements arranged one after another in the longitudinal direction.

3. The lighting strip system as claimed in claim 2, wherein electric connecting elements for the lines for electricity supply and/or signal transmission are respectively provided at the ends of the profile elements.

4. The lighting strip system as claimed in claim 1, wherein in the vertically aligned partition there are provided openings, in which a contact-making socket for making contact with the lines through the operating devices is respectively arranged.

5. The lighting strip system as claimed in claim 1, wherein the receiving regions of the support arrangement are each closed off by side walls opposite the vertically aligned partition, which side walls can be fixed detachably to the protrusions extending from outboard edges of the upper and lower end walls.

6. A lighting strip system comprising:

an elongate support arrangement having a lower end wall with a horizontal underside surface, a lamp mounting fixture mounted on the horizontal underside surface for holding lamp units, wherein the support arrangement has at least one receiving region running in the longitudinal direction of the support arrangement for the support of the lines for electricity supply and/or signal transmission and/or the support of operating devices of the lamp units, wherein the receiving region is closed on at least one side by a detachably fixable side wall having a downwardly protruding extension to which forms optical means for influencing the output of light from an adjacent lamp unit mounted in the lamp mounting fixture.

7. The lighting strip system as claimed in claim 5, wherein the downwardly protruding extension extends outwardly at an angle away from the lamp mounting fixture.

8. The lighting strip system as claimed in claim 7, wherein the protruding extensions form reflectors.

9. The lighting strip system as claimed in claim 7, wherein the protruding extension are formed of translucent material capable of refracting and/or scattering light.

10. The lighting strip system as claimed in claim 5, wherein the lamp units and mountings for holding the lamp units are arranged directly on the support arrangement.

11. The lighting strip system as claimed in claim 7, wherein the lamp units are arranged directly on the support arrangement.

12. The lighting strip system as claimed in claim 7, wherein the downwardly protruding extension extends outwardly at an angle away from the lamp mounting fixture.

* * * * *